United States Patent [19]

Gillis et al.

[11] 4,021,183

[45] May 3, 1977

[54] ARRANGEMENT AND METHOD OF BURNER IGNITION

[75] Inventors: Jay C. Gillis, Chicago; Norman Holcombe, Westmont, both of Ill.

[73] Assignee: Institute of Gas Technology, Chicago, Ill.

[22] Filed: May 7, 1975

[21] Appl. No.: 575,412

[52] U.S. Cl. ..... 431/2; 48/61; 423/648 R; 423/645

[51] Int. Cl.[2] ..... F23G 11/04

[58] Field of Search ..... 431/268, 2; 48/61; 423/648

[56] References Cited

UNITED STATES PATENTS

| | | | |
|---|---|---|---|
| 3,174,833 | 3/1965 | Blackmer | 431/61 X |
| 3,909,187 | 9/1975 | Gregory | 431/268 |

OTHER PUBLICATIONS

Hurd: Chemistry of Hydrides, John Wiley & Sons, (1952), pp. 181–183.

*Primary Examiner*—Edward G. Favors
*Attorney, Agent, or Firm*—Dominik, Knechtel, Godula & Demeur

[57] ABSTRACT

An arrangement and method of burner ignition utilizing hydrogen which is stored, periodically released, and ignited in one fashion or another, to thus function as a pilot to ignite the burner. In accordance with the invention, the hydrogen is stored as a metal hydride in a pressure vessel, such that the process of igniting the burner can be repeated until the metal hydride has given up all of its hydrogen.

6 Claims, 1 Drawing Figure

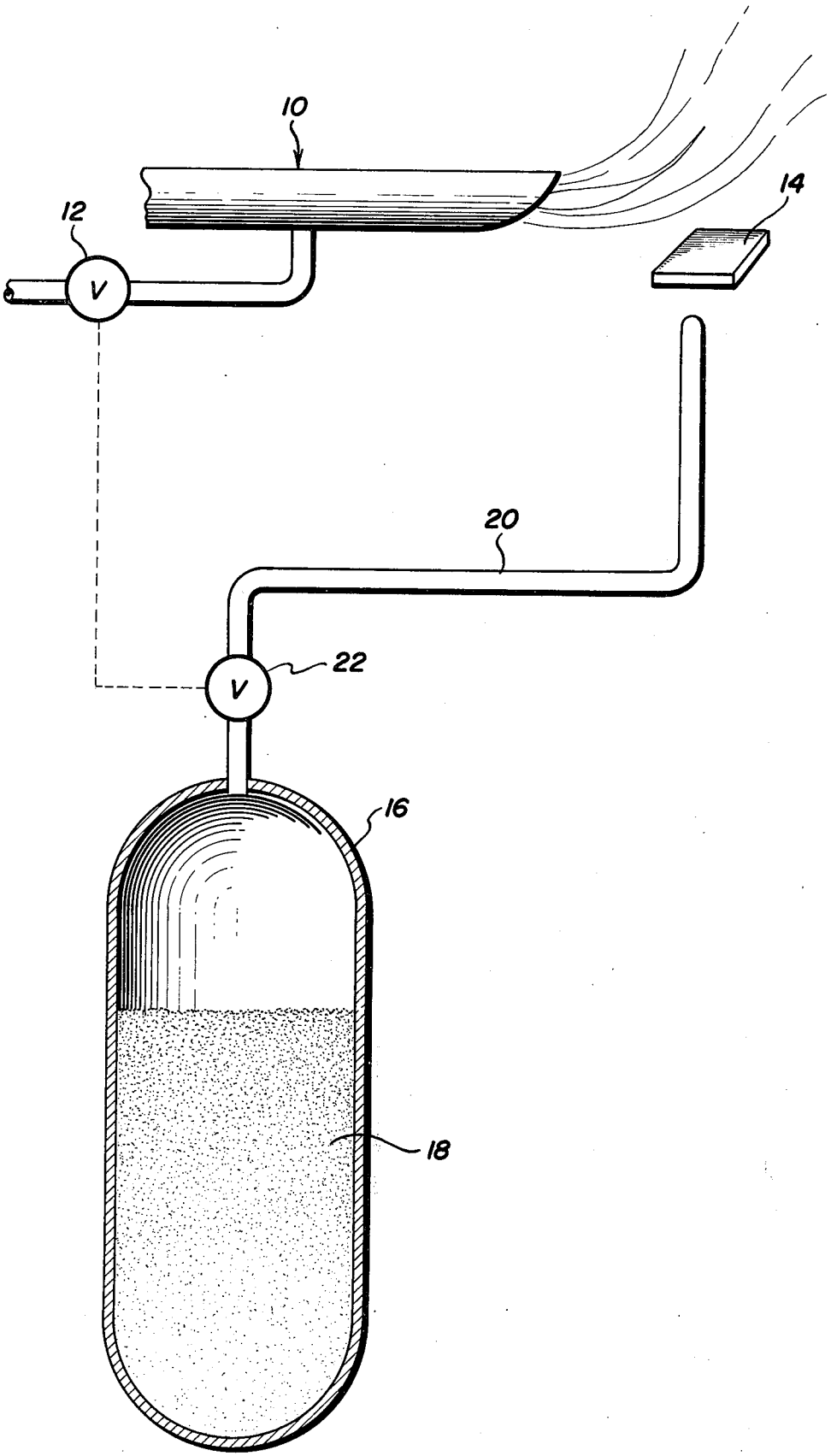
10
12
V
14
20
22
V
16
18

ARRANGEMENT AND METHOD OF BURNER IGNITION

This invention relates, broadly, to an arrangement and method for storing hydrogen. More particularly, it relates to an arrangement and method of burner ignition utilizing hydrogen wherein the hydrogen is stored as a metal hydride.

Various different arrangements and methods have been developed to ignite burners on gas appliances, such as gas ranges and the like, utilizing hydrogen. The hydrogen normally is impinged on a catalyst which ignites the hydrogen, and then the ignited hydrogen functions as a pilot to ignite the burner. In this fashion, the need for a standing pilot flame is eliminated.

The difficulty with such systems is in providing an inexpensive and practical arrangement and method for storing the hydrogen. Various prior systems for doing so are disclosed in U.S. Pat. Nos. 3,681,002 and 3,518,036 and application Ser. No. 466,683, assigned to the Institute of Gas Technology, the assignee of the present invention. While these systems are generally satisfactory, further improved storage techniques are being sought.

In accordance with the present invention, the known fact that hydrogen can be stored as a metal hydride is utilized in providing an ignition device, an application which has not heretofore been recognized or utilized. The hydrogen storage system can be used with any igniter such as, for example, a spark, a glow coil, a catalyst, a resonance tube and the like.

In the broadest sense, the invention comprises a metal hydride, a pressure vessel suitable for containing gas at the ambient temperature "decomposition pressure" of the hydride, and a valve for releasing the hydrogen gas. In the hereinafter disclosed system, the metal hydride, that is, an iron-titanium hydride, is contained in such a pressure vessel and, upon opening a valve, the hydrogen flows from the pressure and is ignited. The ignited hydrogen then ignites a gas burner, and the valve is closed.

When the valve is closed, the pressure in the pressure vessel, of course, is fractionally less than it was before the valve was opened. This lowered pressure causes hydrogen to desorb from the metal hydride, lowering the temperature of the metal hydride bed, and raising the pressure of the hydrogen above the metal hydride bed. When the decomposition pressure is reached, approximately 5 atmospheres with iron-titanium hydride, desorption stops. Heat flows into the metal hydride bed from the environment until its temperature is raised to ambient again. At the end of the process, the metal hydride bed is returned to the same temperature and pressure as before the valve was opened. This process can be repeated until the metal hydride has given up all of its hydrogen. It can therefore be seen that the system requires no corrosive materials, employs no electrochemistry, and functions at room temperature.

In accordance with one embodiment of the invention, the ignition system utilizes a catalyst which is active with hydrogen to ignite the hydrogen flowing from the pressure vessel. In another particularly disclosed embodiment, a resonance tube igniter is utilized to ignite the hydrogen. As indicated above, however, in addition to utilizing a catalyst or a resonance tube igniter other ignition devices such as a spark, a glow coil and the like can be used.

While the use of a catalyst or a spark or a glow coil as an ignition device is generally known, resonance tube igniters are a relatively new device conceived by NASA and its contractors during the last years of the space program.

These resonance tube igniters were used to ignite rockets by changing the kinetic energy of a high velocity gas flow into thermal energy and thus cause ignition. Laboratory models proved very successful, providing ignition times of $10^{-3}$ seconds. Because the ignition is caused by configuration of the device there were never any ignition failures.

Attempts to adapt this device to industrial applications failed because of the need to supply combustible gases at pressures above 150 psia. The concept of storing hydrogen as a metal hydride provides storage of hydrogen at these pressures, thus clearing the way for commercial application.

Generally, a resonance tube igniter consists of a gas supply, an orifice which accelerates the gas to sonic velocity, and a small tube located coaxially and a few diameters in front of the sonic nozzle. When the gas flows into the tube a standing shockwave is set up which quickly heats the gas to temperatures in excess of 1500° F.

Accordingly, it is an object of the present invention to provide an improved arrangement and method for igniting gas burners utilizing hydrogen which is stored as a metal hydride.

Other objects of the invention will in part be obvious and will in part appear hereinafter.

The invention accordingly comprises the several steps and the relation of one or more of such steps with respect to each of the others and the apparatus embodying features of construction, combination of elements and arrangement of parts which are adapted to effect such steps, all as exemplified in the following detailed disclosure, and the scope of the invention will be indicated in the claims.

For a fuller understanding of the nature and objects of the invention, reference should be had to the following detailed description taken in connection with the accompanying drawing, in which:

FIG. 1 is a plan view generally illustrating one embodiment exemplary of the metal hydride hydrogen storage ignition system of the invention.

In the drawing, a gas burner 10 is shown which may be, for example, one of the gas burners of a gas range (not shown), with the gas burner 10 being supplied gas from a source (not shown) under the control of the gas valve 10. In this case, a catalyst 14 which is active with hydrogen is positioned with respect to the burner 10 such that hydrogen that is impinged on the catalyst 14 is ignited and, in turn, ignites the gas supplied to the burner 10.

In accordance with the invention, the hydrogen utilized to ignite the burner 10 is stored as a metal hydride such as, for example, an iron-titanium hydride, in a pressure vessel 16. This pressure vessel 16 may be of any suitable type which is capable of containing gas at the ambient temperature decomposition pressure of the metal hydride. As illustrated, a metal hydride bed 18 is provided in the pressure vessel 16, in an amount sufficient to provide enough hydrogen such that under normal operating conditions, a gas burner can be ignited for a substantial period of time, such as, for example, 1 year, before replacement of the metal hydride bed is required.

The pressure vessel 16 has a conduit 20 coupled to an outlet thereof for delivering the hydrogen to the catalyst 14. A valve 22 is provided in the conduit 20 and is coupled to and operated by the gas valve 12 to control the flow of hydrogen from the pressure vessel 16. Normally, the gas valve 12 has an OFF, an ON and an IGNITION position. In the OFF position, both the supply of gas to the burner 10 and the supply of hydrogen to the catalyst 14 are shut off. In the IGNITION position, gas is supplied to the bas burner 10 and the valve 22 is opened to permit the flow of hydrogen from the pressure vessel 16 through the conduit 20, onto the catalyst 14. After the hydrogen is ignited by the catalyst 14 and has, in turn, ignited the burner 10, the valve 12 is operated to its ON position. In the ON position, the valve 22 is closed shutting off the flow of hydrogen from the pressure vessel 16, but gas is still supplied to the bas burner 10 for its operation. When it is desired to turn off the burner 10, the valve 12 is simply operated to its OFF position.

As indicated above, when the valve 22 is operated to permit hydrogen to flow out of the pressure vessel 16, the pressure in the pressure vessel 16 is fractionally less than it was before the valve 22 was opened. In the case of iron-titanium hydride whose equilibrium pressure is approximately 5 atmospheres, the pressure in the pressure vessel 16 will be slightly less than this value at this time. As a result, hydrogen is desorbed by the metal hydride bed 18, and increases the pressure in the pressure vessel 16. As part of the same desorbing process, since it is endothermic, the temperature of the metal hydride bed 18 is lowered below ambient. The pressure in the pressure vessel 16 continues to rise as hydrogen is desorbed, until the decomposition pressure is reached again, when desorption stops. The temperature of the metal hydride bed 18 is then lower than ambient, and heat is transferred from the environment to the metal hydride bed until it reaches ambient temperature again and the initial conditions duplicated. This process may be repeated until the metal hydride has given up all of its hydrogen.

As indicated above, other types of igniters can be used to ignite the hydrogen flowing from the pressure vessel 16. In particular, a resonance tube igniter can be used in place of the catalyst 14. In such an application where high pressures are essential, michmetal-nickle 5 can be used. This alloy forms a chemical bond with hydrogen at room temperature when the hydrogen pressure exceeds 300 psi. The compound decomposes when the hydrogen pressure drops below 300 psi. Thus, the hydride can be used as a constant pressure hydrogen supply. Another advantage of this hydrogen storage system is that it is as compact as if the hydrogen were liquified.

Because a resonance tube does not require special materials or machining its costs can be insignificant, by coupling a metal hydride hydrogen storage system to a resonance tube, an inexpensive ignition system that is very rugged and perfectly reliable can be provided.

Now that the invention has been described, what is claimed as new and desired to be secured by Letters Patent is:

1. In an ignition system for igniting a gas burner including an ignition means for igniting hydrogen which functions as a pilot flame to ignite gas supplied to the gas burner, the improvement comprising an arrangement wherein said hydrogen is stored as a metal hydride which has an equilibrium decomposition pressure of greater than one atmosphere at ambient temperature in a pressure vessel having valve means for controlling the flow of hydrogen therefrom.

2. In the ignition system of claim 1, wherein said pressure vessel is suitable to contain hydrogen at the ambient temperature decomposition pressure of said metal hydride.

3. In the ignition system of claim 1, wherein said pressure vessel contains a metal hydride bed whereby sufficient hydrogen can be produced to permit repeated ignitions.

4. In an ignition system including a gas burner, a source of hydrogen and ignition means for igniting said hydrogen so that the latter functions as a pilot flame to ignite gas supplied to said gas burner, the improvement comprising a method of providing said source of hydrogen, said method comprising the steps of storing a bed of a metal hydride of the type which has an equilibrium decomposition pressure of greater than one atmosphere at ambient temperature within a pressure vessel, releasing some of said stored hydrogen from said pressure vessel so that it may be ignited by said ignition means to, in turn, ignite gas supplied to said gas burner, releasing some of said stored hydrogen reducing the pressure within said pressure vessel and the reduced pressure causing hydrogen to desorb from said metal hydride bed to thereby replenish the supply of stored hydrogen and increase the pressure in said pressure vessel, the desorption of said hydrogen also lowering the temperature of said metal hydride bed and the temperature thereof being again raised to ambient from heat flow from the environment into said metal hydride bed, said desorption process being stopped when the pressure in said pressure vessel again reaches the decomposition pressure of said metal hydride bed, whereby the process can be repeated until said metal hydride bed has given up all of its hydrogen.

5. In an ignition system for a gas burner, a source of hydrogen and ignition means for igniting said hydrogen so that the latter functions as a pilot flame to ignite gas supplied to said gas burner, said source of hydrogen being stored as a metal hydride which has an equilibrium decomposition pressure of greater than one atmosphere at ambient temperature within a pressure vessel, and means for releasing some of said stored hydrogen from said pressure vessel so that it may be ignited by said ignition means to, in turn, ignite gas supplied to said gas burner, the release of some of said stored hydrogen reducing the pressure within said pressure vessel and the reduced pressure causing hydrogen to desorb from said metal hydride to thereby replenish the supply of stored hydrogen and increase the pressure in said pressure vessel, the desorption of said hydrogen also lowering the temperature of said metal hydride and the temperature thereof being again raised to ambient from heat flow from the environment into said metal hydride and the temperature thereof being again raised to ambient from heat flow from the environment into said metal hydride, said desorption process being stopped when the pressure in said pressure vessels again reaches the decomposition pressure of said metal hydride, whereby the process can be repeated until said metal hydride has given up all of its hydrogen.

6. In the ignition system of claim 5, said ignition means comprising a catalyst active with hydrogen, said hydrogen from said pressure vessel being impinged on and ignited by said catalyst.

* * * * *